US005341666A

United States Patent [19]

Codatto

[11] Patent Number: 5,341,666

[45] Date of Patent: Aug. 30, 1994

[54] DEVICE FOR HANDLING THE BLADES OF A PRESS FOR BENDING SHEETS

[75] Inventor: Antonio Codatto, Lonigo, Italy

[73] Assignee: Sapim Amada S.p.A., Turin, Italy

[21] Appl. No.: 46,416

[22] Filed: Apr. 13, 1993

[30] Foreign Application Priority Data

Apr. 22, 1992 [IT] Italy ..... VI92A000064

[51] Int. Cl.[5] ..... B21D 5/04

[52] U.S. Cl. ..... 72/323; 72/453.02

[58] Field of Search ..... 72/323, 322, 316, 307, 72/453.02, 453.01, 452

[56] References Cited

U.S. PATENT DOCUMENTS

| | | | |
|---|---|---|---|
| 4,843,862 | 7/1989 | Salvagnini | 72/323 |
| 4,901,555 | 2/1990 | Shimoichi | 72/322 |
| 4,944,176 | 7/1990 | Glorieux | 72/323 |

FOREIGN PATENT DOCUMENTS

| | | | |
|---|---|---|---|
| 1423216 | 9/1988 | U.S.S.R. | 72/322 |

*Primary Examiner*—Daniel C. Crane

*Attorney, Agent, or Firm*—Bucknam and Archer

[57] ABSTRACT

A device for moving blades of a press used for bending sheets, has blades supported and placed in motion by a bending block which is movable in the vertical direction with respect to two counter blades with the sheet to be bent being placed between the two counter blades. For the purpose of imparting motion to the bending block with respect to the counter blades, there is provided a track along which the bending block rolls. There are also provided two connecting rods, the upper end of which is hinged to the lower part of the bending block. The two rods are pivoted in the lower part to an arm (7) which is placed substantially radially and which is integral with a cylinder (8). Cylinder (8) is integral with a second arm (9) which is connected with a fluid dynamic cylinder. There may also be provided a second fluid-dynamic cylinder which forms with the first fluid-dynamic cylinder a structure having cylindrical symmetry.

3 Claims, 3 Drawing Sheets

DEVICE FOR HANDLING THE BLADES OF A PRESS FOR BENDING SHEETS

The present invention relates to a device for moving the blades in a press for bending sheets.

Bending presses for sheets which are used for the production of panels which are bent in the portions corresponding to their borders on at least one of their sides have been known for some time. In particular, bending presses are known in which blades supported and placed in motion by a suitable bending block the block being mobile in the vertical direction with respect to two counter blades between which the sheet to be bent is placed. This type of device is described in Italian Patent 1,222,347 filed in the name of the same inventor. According to this device, the bending block is shaped essentially as a "C" and is placed in motion by at least one fluid-dynamic cylinder, the position of which may be predetermined by acting on a shaft disposed longitudinally along the entire length of the device. Around this shaft there is placed an eccentric element placed in a suitable seat formed on the lower extension of the cylinder.

In actual practice, the angular position of this shaft is capable of determining the position of the cylinder and therefore is capable of predetermining the bending angle assumed by the sheet after the fluid-dynamic cylinder performs its function.

This device as well as other similar devices of well known type present the serious problem residing in the difficulty of always maintaining the bending block perfectly parallel with respect to the working plane because if this is not achieved, the bendings obtained are of unacceptable quality.

For the purpose of solving this problem, there has been proposed to use a complex and delicate fluid-dynamic assembly which presents substantial complications with consequent problems both from the constructive as well as the functional point of view. These difficulties become more serious due to the fact that the hydraulic fluids being used operate under conditions of high pressure from 100 bars and higher, and they exhibit a serious decrease in volume, particularly in the case of bendings which are performed asymmetrically with respect to the longitudinal center line of the group of bendings. Alternately, it has been possible to use a complex device which uses a torsion shaft with pinions and racks.

An object of the present invention is to provide a device for moving the blades of bending presses for sheets of the type described hereinabove and which is simpler from the constructive point of view and more reliable from the functional point of view when compared with similar devices of a known type.

The crux of the present invention resides in the fact that the bending block is hinged in its lower part corresponding to the upper extremity of at least two connecting rods disposed essentially vertically and pivoted in their lower part to an arm which is integral and which is disposed in a position essentially radial on a cylinder which has an axis parallel to the working plane.

According to the invention, further, there is provided that a second radial arm is integral with the cylinder and to the external extremity of this second arm there is pivoted the extremity of a stem of a hydraulic cylinder pivoted to the fixed frame of the apparatus.

These above and further features of the invention will be described hereinbelow in detail by reference to a particular embodiment by way of a non-limiting example by reference to the accompanying drawings of which:

Figure 1:
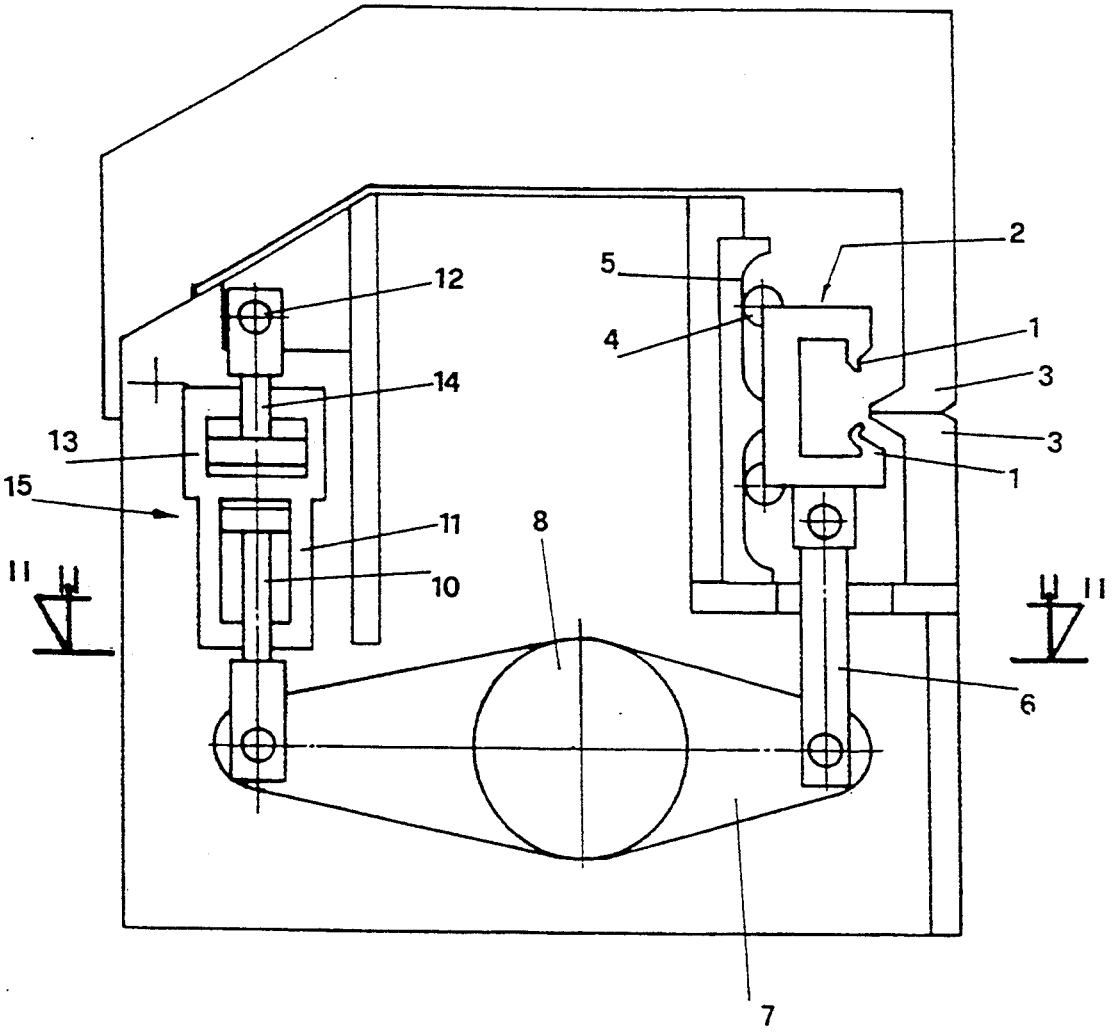
FIG. 1 is a schematic side view of the device of the invention.

As shown in FIG. 1, the press is of the type in which blades (1) are supported and placed in motion by bending block (2) which is mobile in the vertical direction with respect to two counter blades (3) between which the sheet to be bent is placed.

In the rear part, the bending block is provided with rolls (4) capable of rolling along track (5) of an appropriate shape.

The main feature of the device of the invention consists of the fact that the upper end of at least two connecting rods (6) is pivoted to the lower part of the bending block. The two connecting rods are in turn pivoted in their lower part to an arm (7) as shown also in FIG. 2 which is integral and which is disposed in a position substantially radial on cylinder (8), the latter being disposed with an axis which is parallel to the working plane.

Figure 2:
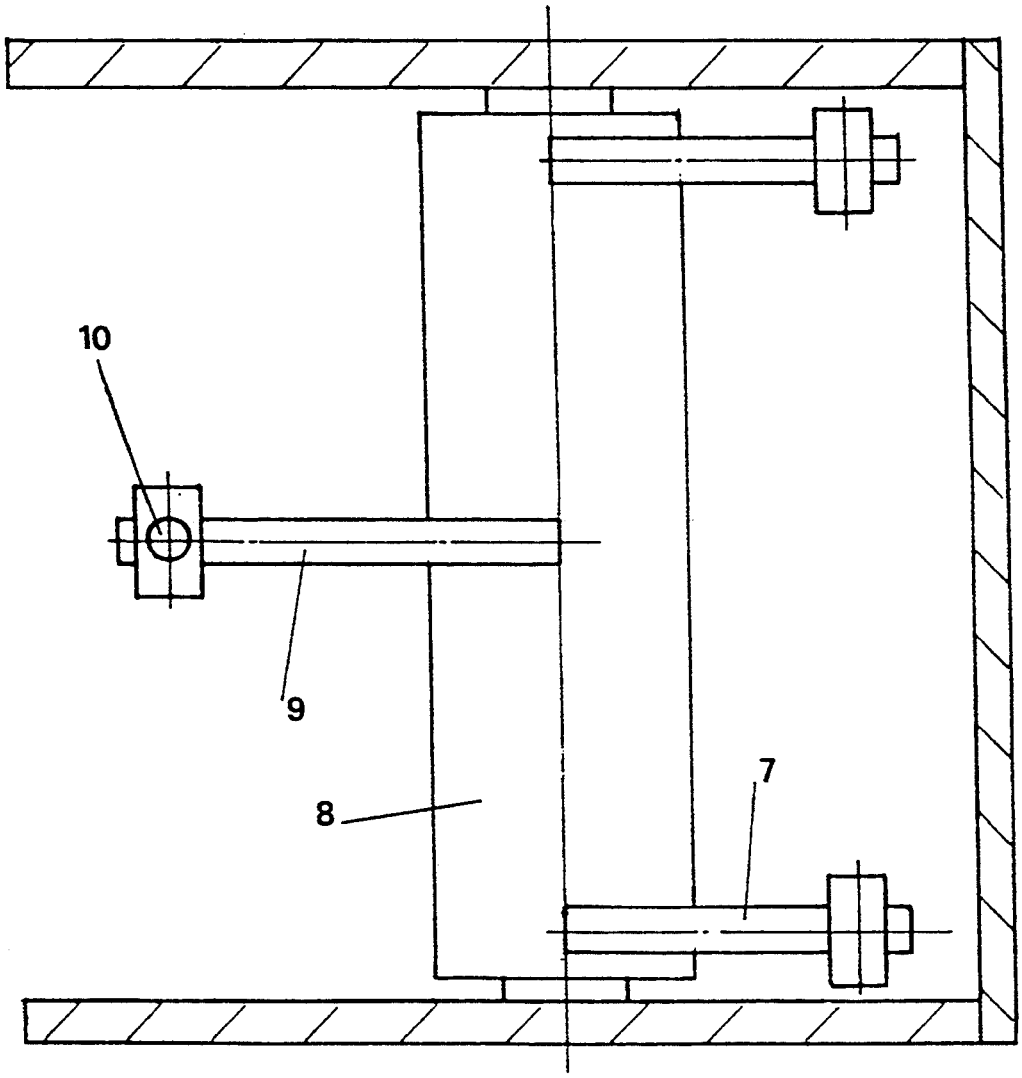
FIG. 2 illustrates a transversal view in cross section according to lines II—II in FIG. 1.
Figure 3:
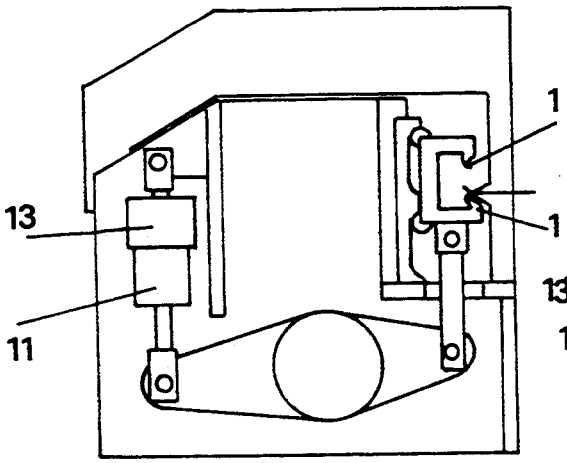
FIGS. 3–6 illustrate the sequence of the phases of operation according to the invention.
Figure 4:
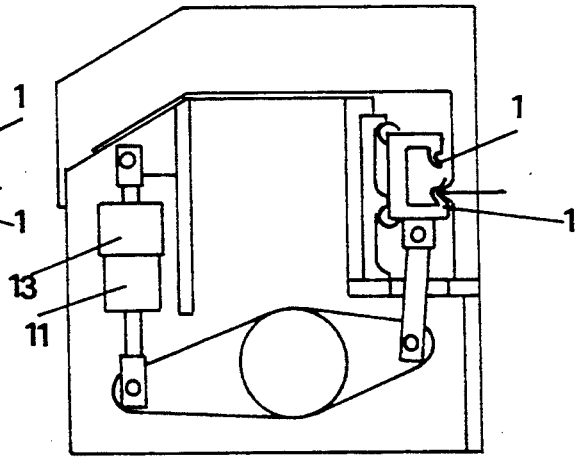
Figure 5:
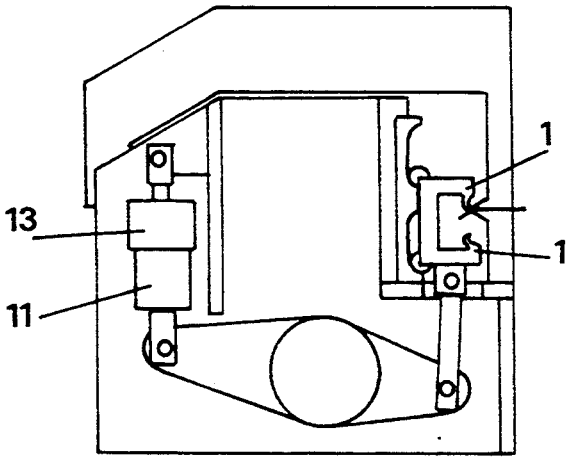
Figure 6:
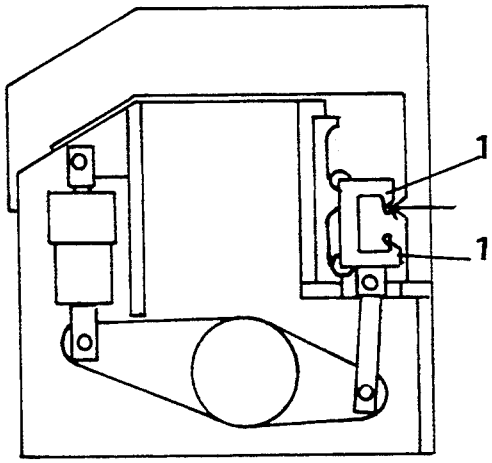

FIG. 2 also shows that advantageously each one of the two connecting rods is placed in a position corresponding to one end of cylinder (8). A further radial arm (9) is integral with cylinder (8).

To the end of the arm (9) there is pivoted the end of stem (10) of hydraulic cylinder (11) which in turn is pivoted to the fixed frame of the apparatus. Advantageously on top of cylinder (11) and integral with respect to the latter, there is placed another fluid-dynamic cylinder (13) which forms with cylinder (11) a single structure (15) having cylindrical symmetry. The second cylinder (13) has a stem (14) which is coaxial with respect to the first stem (10). The two stems exit from the opposite surfaces of the structure (15). In particular, the extremity of stem (14) placed coaxially with respect to cylinder (13) is pivoted in point (12) to the fixed frame of the apparatus.

The motions of the bending block (2), for the purpose of obtaining effectively the bending action, are made dependent to the corresponding motion of the stem (14) in the interior of the corresponding fluid-dynamic cylinder (13). In the case in which there is used only cylinder (11) with the only stem (10), it is evident that the motions of the bending block (2) depend only on the motion of stem (10). It is clear that in this manner the device is more economical but it is inherently slower with respect to the device which includes two coupling cylinders.

The device according to the invention is superior with respect to similar devices of known type because it guarantees the parallelism of the bending block with respect to the working plane. Further, with the known hydraulic devices, it is necessary to restore the parallelism of the bending block in the loading phase of every new panel with consequences of substantial complications. In the devices which have pinions and racks, there is no parallelism and this involves substantial wear of the teeth of the rack. Finally, the device according to the invention permits to use one or two cylinders instead of a plurality of cylinders, at least five, which are used in known devices with substantial saving from an economical point of view. Finally, the device according to the invention guarantees absolute uniformity in the bending of the sheet.

What is claimed is:

1. In a bending press for bending a sheet on a working plane having a fixed frame, two counter blades (3) on said frame adapted to receive said sheet therebetween in said working plane, a substantially C shaped bending block (2) having bending blades (1) supported at the extremities thereof, said bending block (2) being provided with rolls (4) adapted to roll along a track (5) perpendicular to said working plane, and two connecting rods (6) substantially perpendicular to said working plane and having upper and lower parts, the upper parts of said connecting rods being hingedly connected to a lower part of said bending block (2), the improvement comprising an axially rotatable cylinder (8) whose axis is parallel to said working plane, a first arm (7) associated with each connecting rod (6) integral with and radially extending from said cylinder (8) and having an axis substantially parallel to said working plane, a lower part of each connecting rod (6) being hingedly connected to each said first arm (7), a second arm (9) integral with and radially extending from said cylinder (8) and having an exterior end, and a fluid-dynamic cylinder (11) hingedly connected to said fixed frame at a first end and having an actuated stem (10) at a second end hingedly connected to the exterior end of said second arm (9) whereby actuation of said stem (10) by said fluid-dynamic cylinder (11) translates into movement of said bending block (2) perpendicular to said working plane.

2. The bending press as defined in claim 1, wherein said each first arm (7) is disposed on a lateral end of said cylinder (8).

3. The bending press as defined in claim 1, which further comprises a second fluid-dynamic cylinder (13) integral with said fluid-dynamic cylinder (11) and forming a single structure (15) therewith having cylindrical symmetry, said second fluid-dynamic cylinder (13) being disposed between said fluid-dynamic cylinder (11) and said fixed frame and having a stem (14) coaxial with stem (10) of said fluid-dynamic cylinder (11), said stem (14) and stem (10) exiting from opposite surfaces of structure (15), and an end of stem (14) located externally of said fluid-dynamic cylinder (13) being hingedly connected to said fixed frame.

* * * * *